US006336282B1

(12) United States Patent
Buffoli

(10) Patent No.: US 6,336,282 B1
(45) Date of Patent: Jan. 8, 2002

(54) DEVICE FOR AUTOMATICALLY PUTTING A REVOLVER ON SAFETY

(75) Inventor: Angelo Buffoli, Brescia (IT)

(73) Assignee: Armi San Marco S.R.L. (IT)

( * ) Notice: Subject to any disclaimer, the term of this patent is extended or adjusted under 35 U.S.C. 154(b) by 0 days.

(21) Appl. No.: 09/484,649

(22) Filed: Jan. 18, 2000

(30) Foreign Application Priority Data

Aug. 26, 1999 (IT) ..... BS99A028

(51) Int. Cl.[7] ..... F41A 17/00
(52) U.S. Cl. ..... 42/66; 42/70.08
(58) Field of Search ..... 42/66, 69.03, 70.08

(56) References Cited

U.S. PATENT DOCUMENTS 3,803,741 A * 4/1974 Ducommun ..... 42/66
4,133,127 A * 1/1979 Piscetta ..... 42/66
4,894,939 A * 1/1990 Perry ..... 42/66
5,560,132 A * 10/1996 Merlino ..... 42/66
5,664,356 A * 9/1997 Pantuso et al. ..... 42/65
5,724,759 A * 3/1998 Kilham ..... 42/66

* cited by examiner

*Primary Examiner*—Michael J. Carone
*Assistant Examiner*—Michelle Thomson
(74) *Attorney, Agent, or Firm*—McGlew and Tuttle, P.C.

(57) ABSTRACT

A device for automatically putting revolvers on safety is provided. The device includes a trigger (16) in a mounting position and a percussion or firing position for the control of the hammer. The hammer is stressed by a release spring (15). A spring-loaded (22) safety piston (20) is arranged between the hammer (14) and the stock (11) of the gun, and is intended for spacing the hammer with the firing pin in the case of a percussion, automatically placing it in a neutral position, after each firing action and with the trigger released.

6 Claims, 1 Drawing Sheet

DEVICE FOR AUTOMATICALLY PUTTING A REVOLVER ON SAFETY

FIELD OF THE INVENTION

The present invention pertains to single-action revolvers, and more specifically, a device for automatically putting said revolvers on safety.

BACKGROUND OF THE INVENTION

Safety devices for revolvers, including those that have a means intended for intercepting the hammer when it is moved from the mounting or armed position to the firing position without acting on the trigger or in an involuntary or accidental manner in order to prevent the uncontrolled firing of a shot, are already known. An example of a safety device of this type has been described, e.g., in the co-pending Italian patent application No. BS 99 A 000028 of the same applicant. This patent application and a translation is attached in an appendix. Italian patent application No. BS99A000028 corresponds to U.S. patent application Ser. No. 09/356,761 filed Jul. 19, 1999.

SUMMARY AND OBJECTS OF THE INVENTION

The primary object of the present invention is to propose a device for putting on the safety which is applied to the hammer of a revolver, which automatically engages the released hammer to keep same in a passive position, and which may be provided in addition to the hammer interception safety, which may already be equipped with the revolver.

Therefore, another object of the present invention is to maintain the hammer of a revolver in a position, in which, even if it is released, it is prevented from performing the action of percussion on the ammunition in line with the firing pin, assisted, in this sense, by the release of the release spring from the hammer proper, with the advantage, among others, of being able to safely load all possible ammunition in the cylinder of the gun.

According to the invention, a device for automatically putting on a safety of a revolver is provided The revolver has a stock, a hammer hinged to the stock and rotating between a mounting position and a percussion or firing position, a trigger for the control of the hammer, and in which the said hammer is stressed by a release spring and has a front firing pin. A spring-loaded safety piston is arranged between the hammer and the stock of the gun and is intended for spacing the hammer with the firing pin from the percussion front, thereby placing it in a neutral position, after each firing action and with the trigger released.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
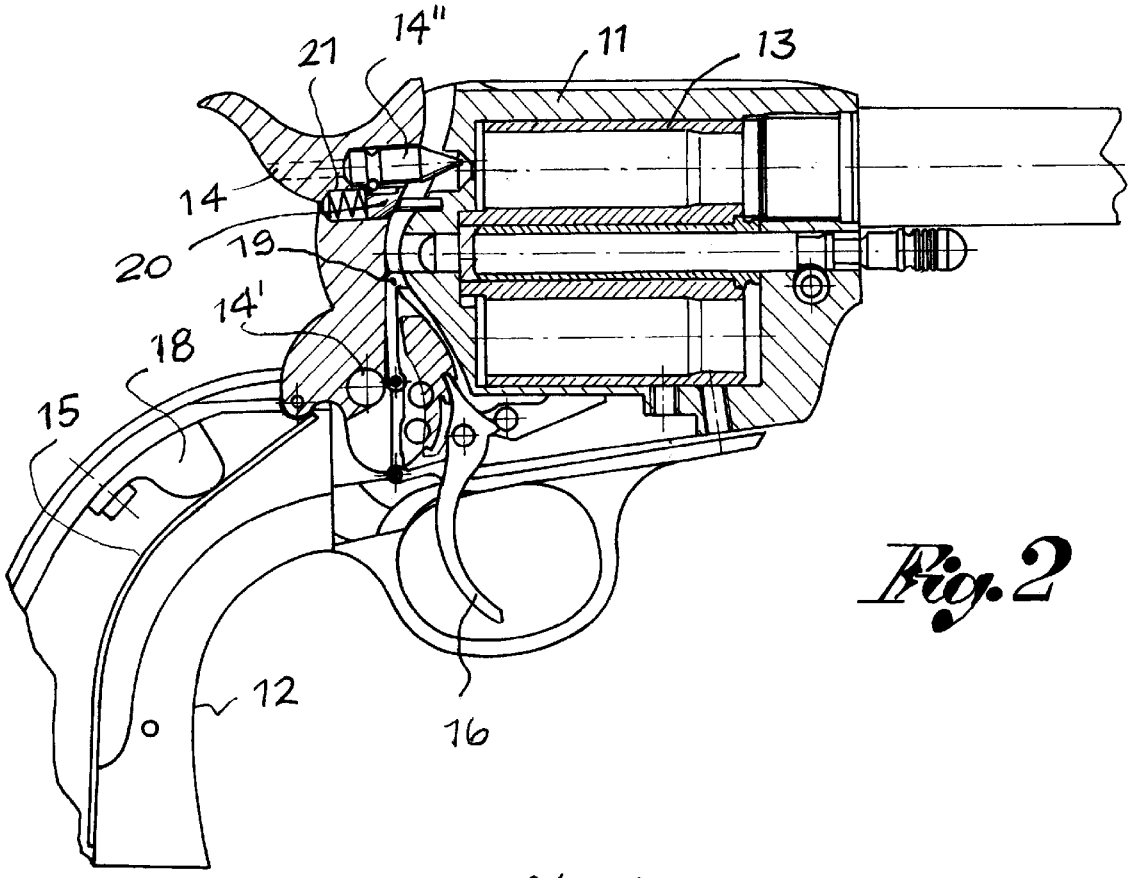
FIG. 2 is a view similar that of FIG. 1 but with the hammer in a safe and passive position.

Referring to the drawings in particular, only some components of a revolver are shown. Specifically, the figures show: A part of the stock 11 with an associated grip 12; the cylinder 13 for the ammunition, mounted, rotating, in the stock 11; the hammer 14 with a respective release spring 15; the trigger 16 for controlling the hammer and for the rotation of the cylinder by means of a bar (not shown).

The hammer 14 is mounted on the stock 11 and is rotatable on an axis 14' between a mounting or arming position and a percussion and firing position. In the front, the hammer has a firing pin 14" and is stressed by the release spring 15, tending to move it from the mounting position to the firing position. The mounting or arming position of the hammer is obtained with its rotation in opposition to the release spring 15. However, if the hammer is in the firing position (FIG. 1), the release spring 15 comes up against a locking element 18 in the grip and is stopped by this element 18 and released by the hammer. In other words, the hammer, when it has performed the percussion action, is no longer stressed by the release spring, having a certain freedom.

The revolver may be, e.g., provided with a safety bar 19 mounted in the hammer 14, arranged and acting as described in the above-mentioned, co-pending patent application, a translation of which is attached in the appendix.

According to the present invention, a safety device that is able to remove the firing pin from the percussion front of the ammunition automatically after each firing, and when the gun is not used, is mounted on the hammer 14, in parallel to the firing pin 14". This device comprises a piston 20 that is accommodated and slides in a front seat 21 provided in the hammer. The piston 20 has a rod 22 turned towards the stock 11 of the gun and is stressed by a safety spring 23.

The axial sliding of the piston 20 in the seat 21 is limited by an interception pin 24 cooperating with two shoulders on the piston with which it interacts alternately. The spring 23 is arranged and acts in the manner of usually keeping the piston moved forwards towards the stock and permitting a return into the seat 21 of the piston when the hammer is in percussion.

In practice, when the hammer 14 is released from the mounting position, which is induced by the release spring 15, it rotates in the percussion position or in the position of firing the ammunition. Then the safety piston 20 comes up against the stock 11 and returns to the seat 21 against the action of the respective spring 23 which will be compressed. It should be noted that, given the force of the release spring 15 of the hammer, the spring 23 of the piston 20 has essentially no effect, by choice, on the percussion action of the hammer.

Figure 1:
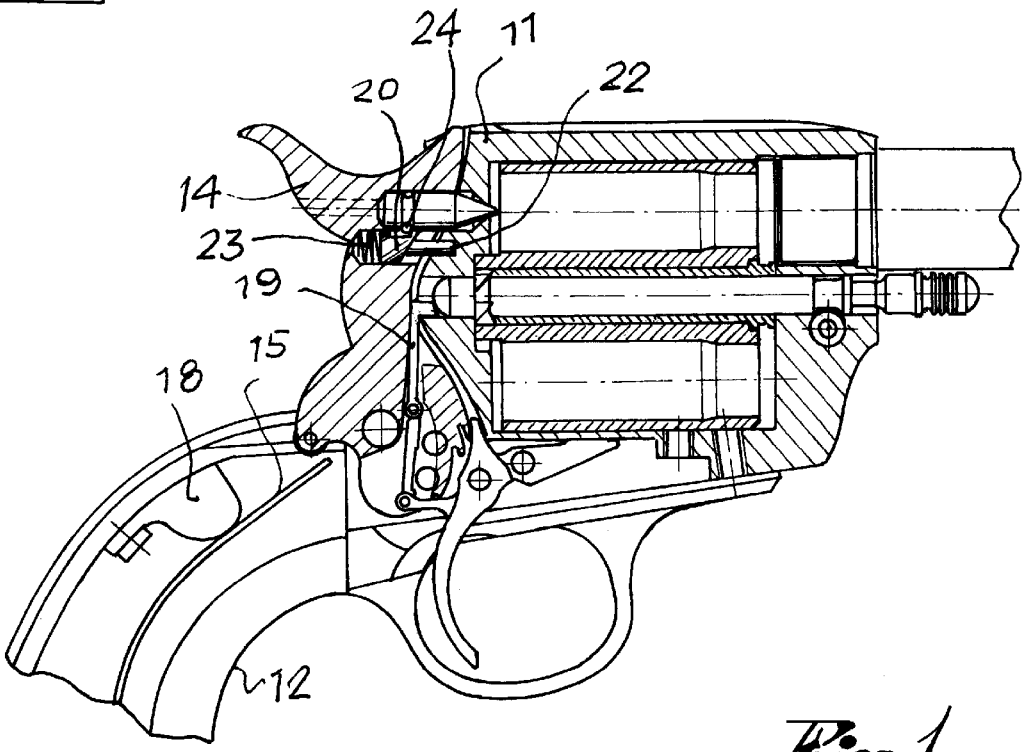
FIG. 1 is partially sectional partial view of a revolver with the hammer released in the firing position.

At any rate, after the percussion and firing action, the hammer 14 is released by the release spring 15, which, as stated above, is stopped against the lock 18 (FIG. 1). Thus, the safety spring 23, reacting to the preceding compression, on the one hand, keeps the rod of the piston 20 supported against the stock, and on the other hand, causes a partial rotation backwards of the hammer 14 (FIG. 2), moving the firing pin away from the percussion front. The hammer will then be arranged and kept in a neutral position, in which rests, on the one hand, the release spring 15, and on the other hand, the stock of the gun by means of the safety piston, which is at any rate prevented from performing any percussion action as long as there is no action on the trigger.

While a specific embodiment of the invention has been shown and described in detail to illustrate the application of the principles of the invention, it will be understood that the invention may be embodied otherwise without departing from such principles.

What is claimed is:

1. A device for automatically putting a revolver into a safety state, the device comprising:

a stock;

a hammer hinged to said stock and rotating between a mounting position and a firing position;

a trigger for the control of said hammer;

a release spring stressing said hammer, said hammer having a front firing pin;

a spring-loaded safety piston arranged between said hammer and said stock for spacing said hammer with said firing pin from a percussion front and placing said hammer in a neutral position, after each firing action and with said trigger released, said release spring being stopped and released from said hammer by means of a locking element when said hammer is in the firing position and in such a way that said spring-loaded piston is able to move said hammer backwards into said neutral position after the firing without interference from the action of said release spring.

2. The device in accordance with claim 1, wherein said hammer has a front seat, in which said safety piston is arranged and slides in said seat, and has a rod turned towards said stock, and a safety spring in said seat, stressing said piston, usually pushing said piston towards said stock, whereby movements of said piston in said seat are limited by an interception pin.

3. The device in accordance with claim 1, further comprising: a safety bar, arranged between said hammer and said stock of the gun if the hammer is released from said mounting position without acting on said trigger.

4. A revolver with automatic safety feature, the revolver comprising:

a stock;

a hammer hinged to said stock and rotating between a mounting position and a percussion position, said hammer having a front firing pin;

a trigger operatively connected to said hammer for the control of said hammer;

a release spring biasing said hammer toward said percussion position;

a spring-loaded safety piston arranged between said hammer and said stock for spacing said hammer with said firing pin from a percussion front and placing said hammer in a neutral position, after each firing action and with said trigger released;

a locking element stopping and releasing said release spring from said hammer when said hammer is in the firing position and in such a way that said spring-loaded piston is able to move said hammer backwards into said neutral position after the firing without interference from action of said release spring.

5. The device in accordance with claim 4, wherein said hammer has a front seat, in which said safety piston is arranged and slides in said seat, and has a rod turned towards said stock, and a safety spring in said seat, stressing said piston, usually pushing said piston towards said stock, whereby movements of said piston in said seat are limited by an interception pin.

6. The device in accordance with claim 4, further comprising: a safety bar, arranged between said hammer and said stock of the gun if the hammer is released from said mounting position without acting on said trigger.

* * * * *